US010843490B2

(12) United States Patent
Sekine et al.

(10) Patent No.: US 10,843,490 B2
(45) Date of Patent: Nov. 24, 2020

(54) PRINTER INCLUDING GUIDE ROLLER WITH ROLLER PART THAT ROTATES IN CONTACT WITH RECORDING SHEET

(71) Applicant: FUJITSU COMPONENT LIMITED, Tokyo (JP)

(72) Inventors: Kenji Sekine, Tokyo (JP); Masahiro Tsuchiya, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/437,101

(22) Filed: Jun. 11, 2019

(65) Prior Publication Data

US 2019/0381814 A1 Dec. 19, 2019

(30) Foreign Application Priority Data

Jun. 15, 2018 (JP) ..... 2018-114166

(51) Int. Cl.

| | |
|---|---|
| ***B41J 11/04*** | (2006.01) |
| ***B41J 3/407*** | (2006.01) |
| ***B41J 23/02*** | (2006.01) |
| ***B41J 15/04*** | (2006.01) |

(52) U.S. Cl.

CPC ..... *B41J 11/04* (2013.01); *B41J 3/4075* (2013.01); *B41J 15/046* (2013.01); *B41J 23/02* (2013.01)

(58) Field of Classification Search

CPC . B41J 11/04; B41J 15/046; B41J 15/04; B41J 23/02; B41J 3/4075; B41J 15/042

See application file for complete search history.

(56) References Cited

U.S. PATENT DOCUMENTS

| | | | | |
|---|---|---|---|---|
| 2,293,769 A * | 8/1942 | Sherman | ..... | B41J 11/28 400/606 |
| 5,199,806 A * | 4/1993 | Fujioka | ..... | B41J 11/36 400/616 |
| 9,724,947 B2 | 8/2017 | Yada et al. | | |

FOREIGN PATENT DOCUMENTS

| | | | |
|---|---|---|---|
| JP | 2001-130800 | | 5/2001 |
| JP | 2001130800 A | * | 5/2001 |
| JP | 2017-052213 | | 3/2017 |

* cited by examiner

*Primary Examiner* — Henok D Legesse
(74) *Attorney, Agent, or Firm* — IPUSA, PLLC

(57) ABSTRACT

A printer includes a head unit and a platen unit. The head unit includes a print head. The platen unit includes a platen roller, a support, and a guide roller. The platen roller is rotatably supported on the support and configured to rotate to convey recording sheet. The guide roller includes a roller part, and the roller part is configured to rotate in contact with the recording sheet as the recording sheet is conveyed.

7 Claims, 11 Drawing Sheets

PRINTER INCLUDING GUIDE ROLLER WITH ROLLER PART THAT ROTATES IN CONTACT WITH RECORDING SHEET

CROSS-REFERENCE TO RELATED APPLICATION

The present application is based on and claims priority to Japanese patent application No. 2018-114166, filed on Jun. 15, 2018, the entire contents of which are incorporated herein by reference.

BACKGROUND OF THE INVENTION

1. Field of the Invention

The present invention relates to printers.

2. Description of the Related Art

Printers that issue receipts or the like are widely used for shop registers, automated teller machines (ATMs) or cash dispensers (CDs) in banks, etc. Such printers convey recording paper and perform printing on the paper using a print head.

According to such printers, a lid pivotably supported on a printer body is opened to allow a paper roll to be loaded into a paper holder in the printer body. See Japanese Laid-open Patent Publication Nos. 2017-52213 and 2001-130800.

SUMMARY OF THE INVENTION

According to an aspect of the present invention, a printer includes a head unit and a platen unit. The head unit includes a print head. The platen unit includes a platen roller, a support, and a guide roller. The platen roller is rotatably supported on the support and configured to rotate to convey a recording sheet. The guide roller includes a roller part, and the roller part is configured to rotate in contact with the recording sheet as the recording sheet is conveyed.

DESCRIPTION OF THE EMBODIMENTS

Figure 1:
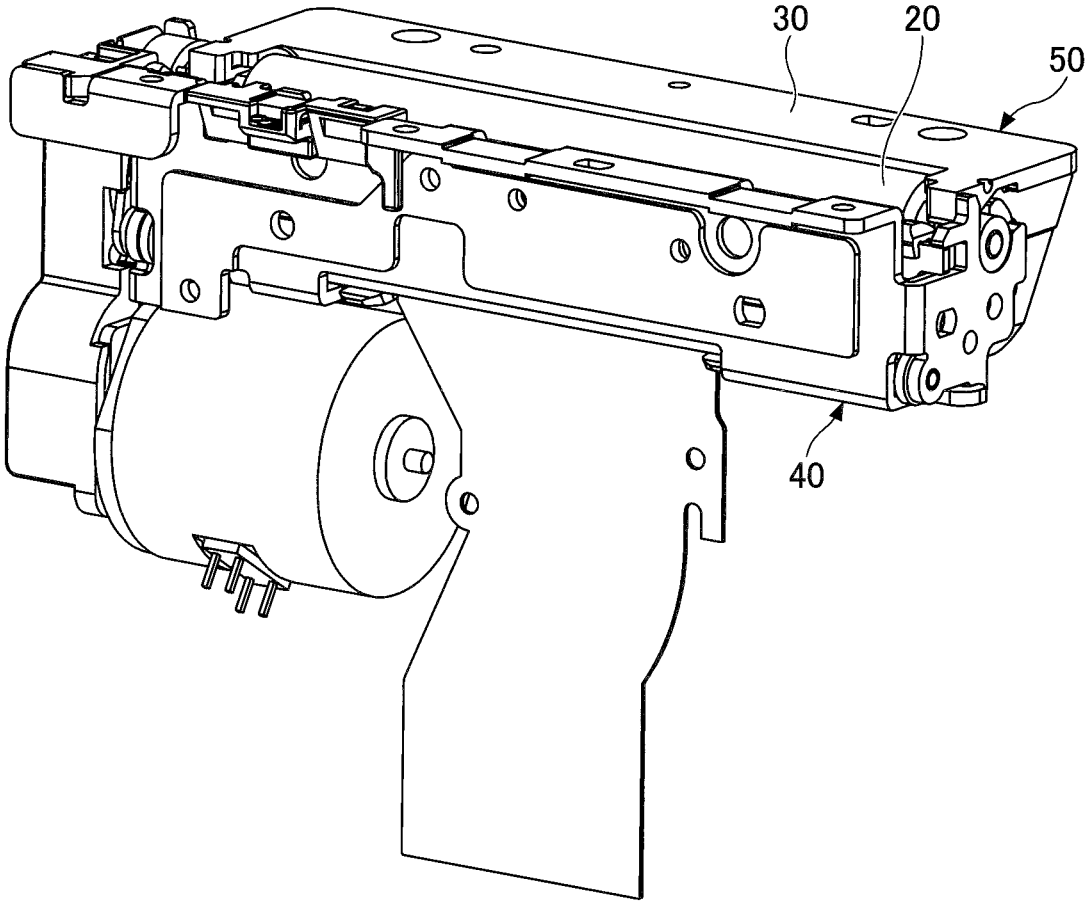
FIG. 1 is a perspective view of a printer.

Printers convey a recording sheet such as paper by holding the recording paper between a print head and a platen roller and rotating the platen roller, and perform printing on the conveyed recording paper. Some recording paper has a heat sensitive surface on one side and an adhesive surface on the other side, and the adhesive surface may be provided with no liner. The adhesive surface of linerless paper may adhere to a sheet guide near a platen roller to prevent the recording paper from being normally conveyed.

A printer according to an embodiment of the present invention can normally convey recording paper whose bottom surface is an adhesive surface.

Embodiments of the present invention are described below with reference to the accompanying drawings. The same members or the like are referred to using the same reference numeral, and duplicate description thereof is omitted.

First Embodiment

Figure 2:
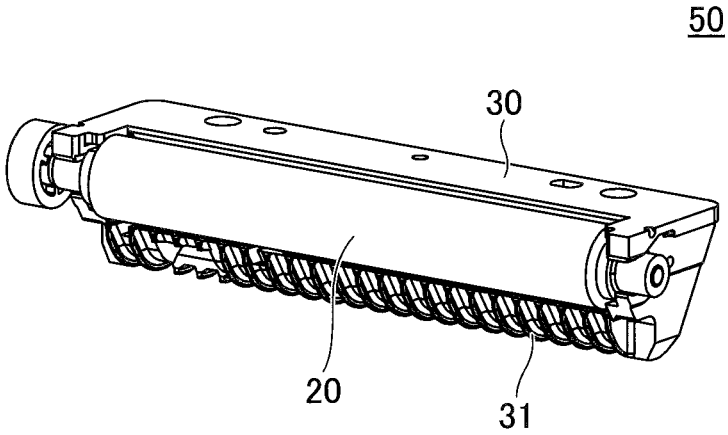
FIG. 2 is a perspective view of a platen unit.
Figure 3:
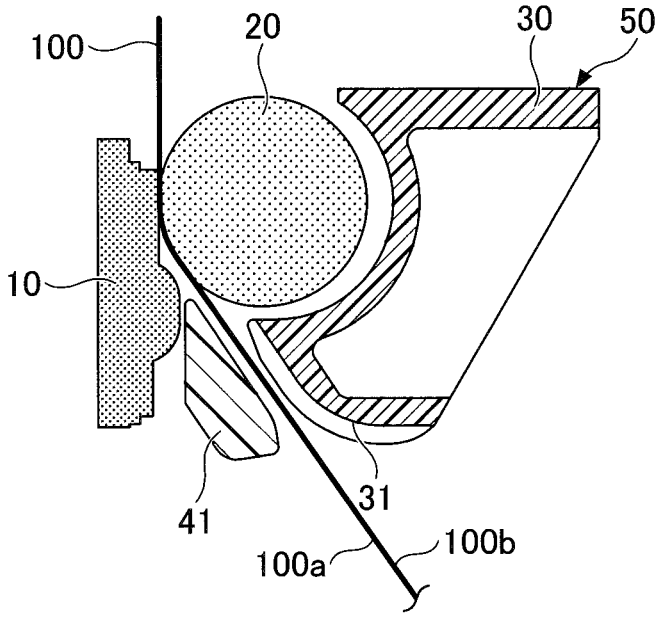
FIG. 3 is a partial cross-sectional view of the printer.

A printer is described with reference to FIGS. 1 through 3. FIG. 1 is a perspective view of the printer. FIG. 2 is a perspective view of a platen unit. FIG. 3 is a partial cross-sectional view of the printer.

The printer includes a print head 10, a platen roller 20, and a support 30 to rotatably support the platen roller 20. The print head 10 is attached to a head unit 40. The platen roller 20 and the support 30 form a platen unit 50.

By connecting the head unit 40 and the platen unit 50, the print head 10 contacts the platen roller 20 as illustrated in FIG. 3. As the platen roller 20 rotates, recording paper 100 held between the print head 10 and the platen roller 20 is conveyed and subjected to printing by the print head 10. The recording paper 100 passes between a sheet guide 31 formed on the support 30 and a sheet guide 41 on the head unit 40 side, and is conveyed toward a nip between the print head 10 and the platen roller 20.

When the recording paper 100 has a heat sensitive top surface 100*a* and an adhesive bottom surface 100*b*, the top surface 100*a* faces the print head 10 and the bottom surface 100*b* faces the platen roller 20. When the platen roller 20 is formed of a silicon-containing resin material, the bottom surface 100*b* is less likely to adhere to the platen roller 20, and peels off relatively easily even when adhering to the platen roller 20. When the bottom surface 100*b* adheres to the guide 31, however, it may be impossible to convey the recording paper 100 with the rotation of the platen roller 20. This is because while the support 30 is made of resin or metal to maintain strength in particular, the bottom surface 100*b* is less likely to be removed from such a material once adhering thereto.

Figure 4:
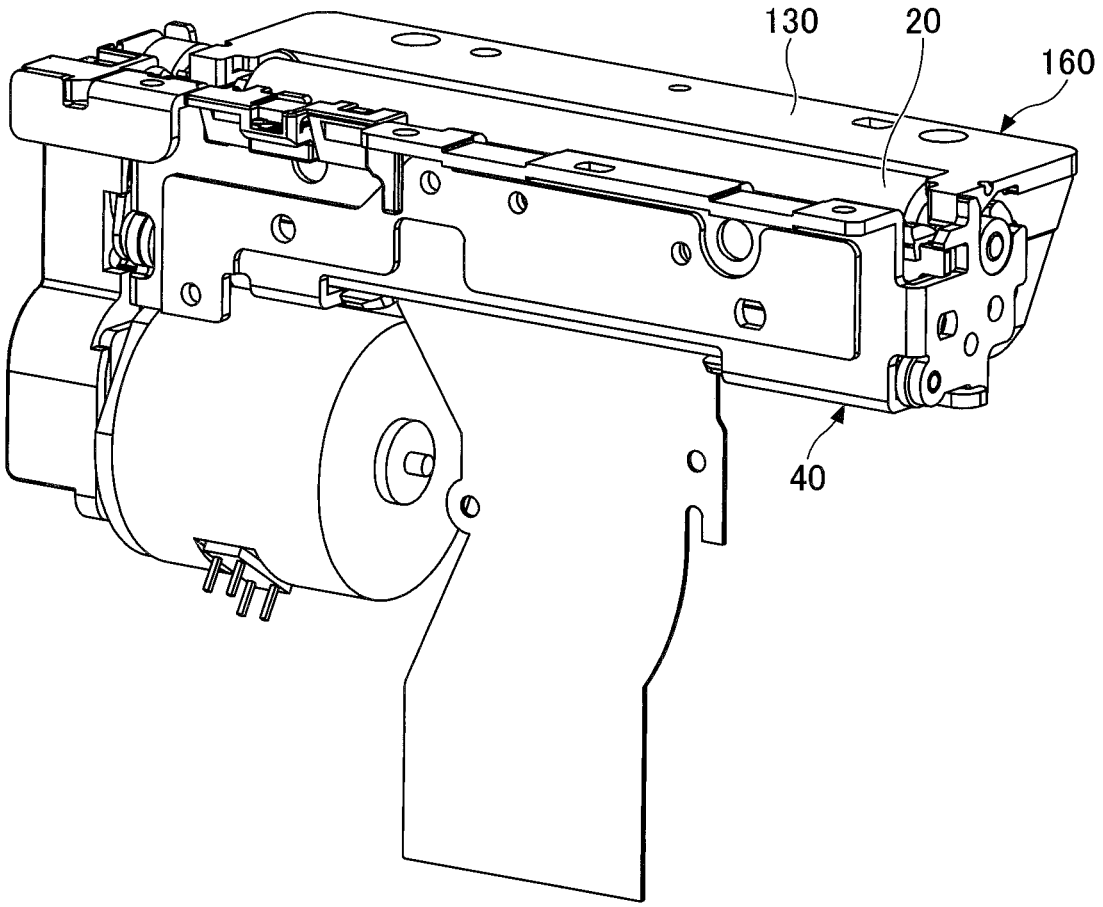
FIG. 4 is a perspective view of a printer according to a first embodiment.
Figure 5:
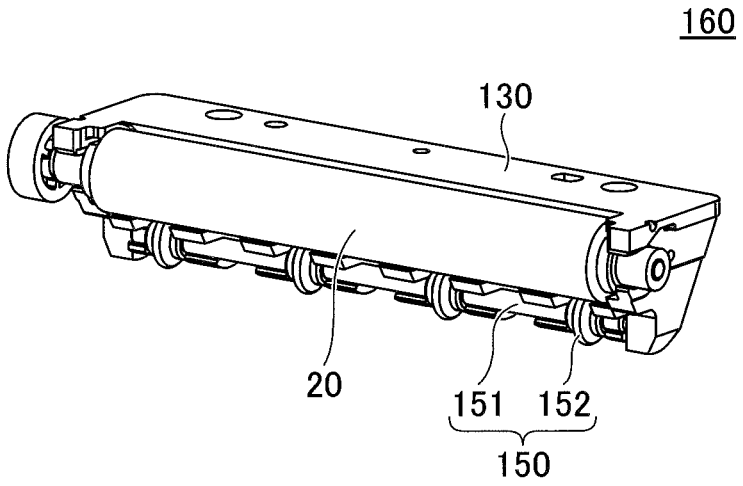
FIG. 5 is a perspective view of a platen unit according to the first embodiment.
Figure 6:
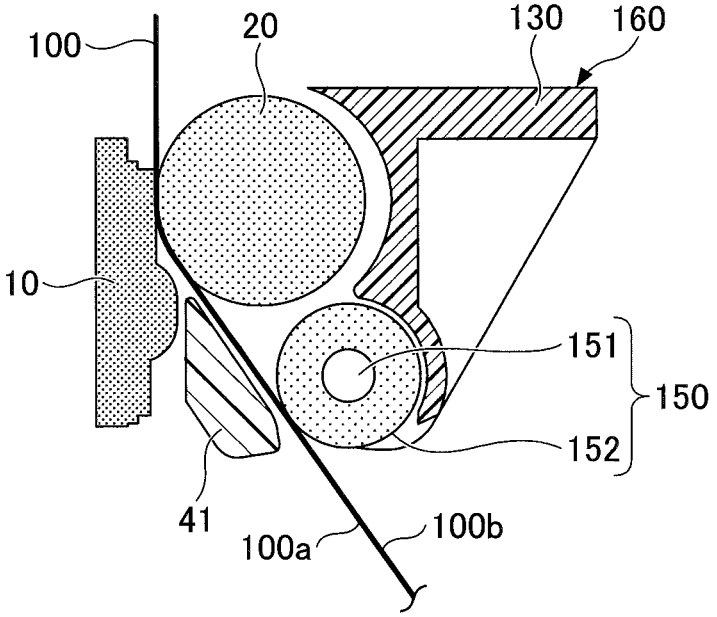
FIG. 6 is a partial cross-sectional view of the printer according to the first embodiment.

A printer according to a first embodiment is described with reference to FIGS. 4 through 6. FIG. 4 is a partial perspective view of the printer. FIG. 5 is a perspective view of a platen unit. FIG. 6 is a partial cross-sectional view of the printer.

The printer includes the head unit 40 to which the print head 10 such as a thermal head is attached and a platen unit 160. The platen unit 160 includes the platen roller 20, a support 130 that rotatably supports the platen roller 20, and a guide roller 150. The roller 150 is rotatably attached to the support 130 upstream of the print head 10 and the platen roller 20 in a conveyance direction in which the recording paper 100 is conveyed.

The guide 41 is so provided on the head unit 40 as to face the roller 150 across a path through which the recording paper 100 is conveyed toward a nip between the print head 10 and the platen roller 20.

Figure 7:
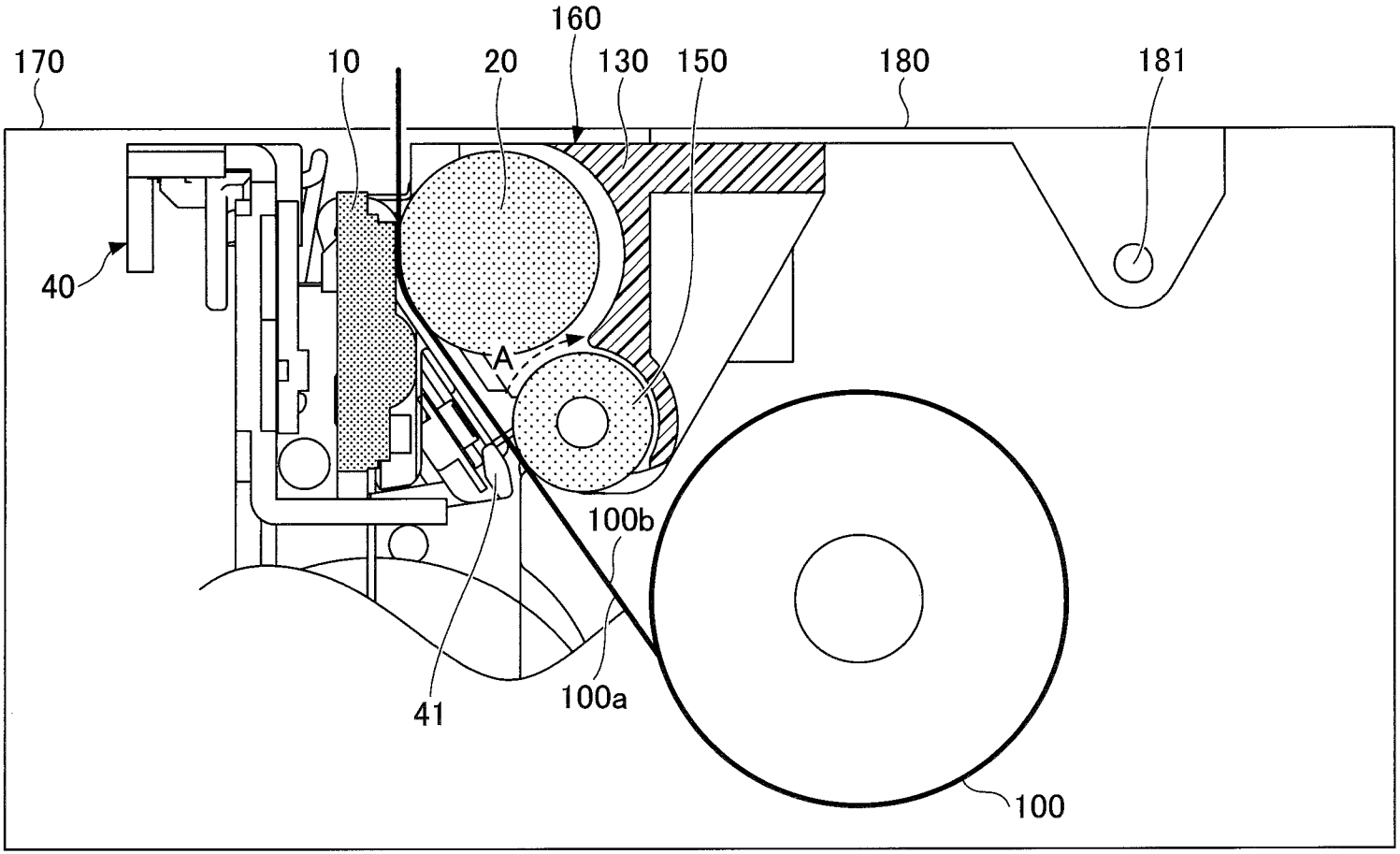
FIG. 7 is a diagram illustrating the printer with a lid closed.
Figure 8:
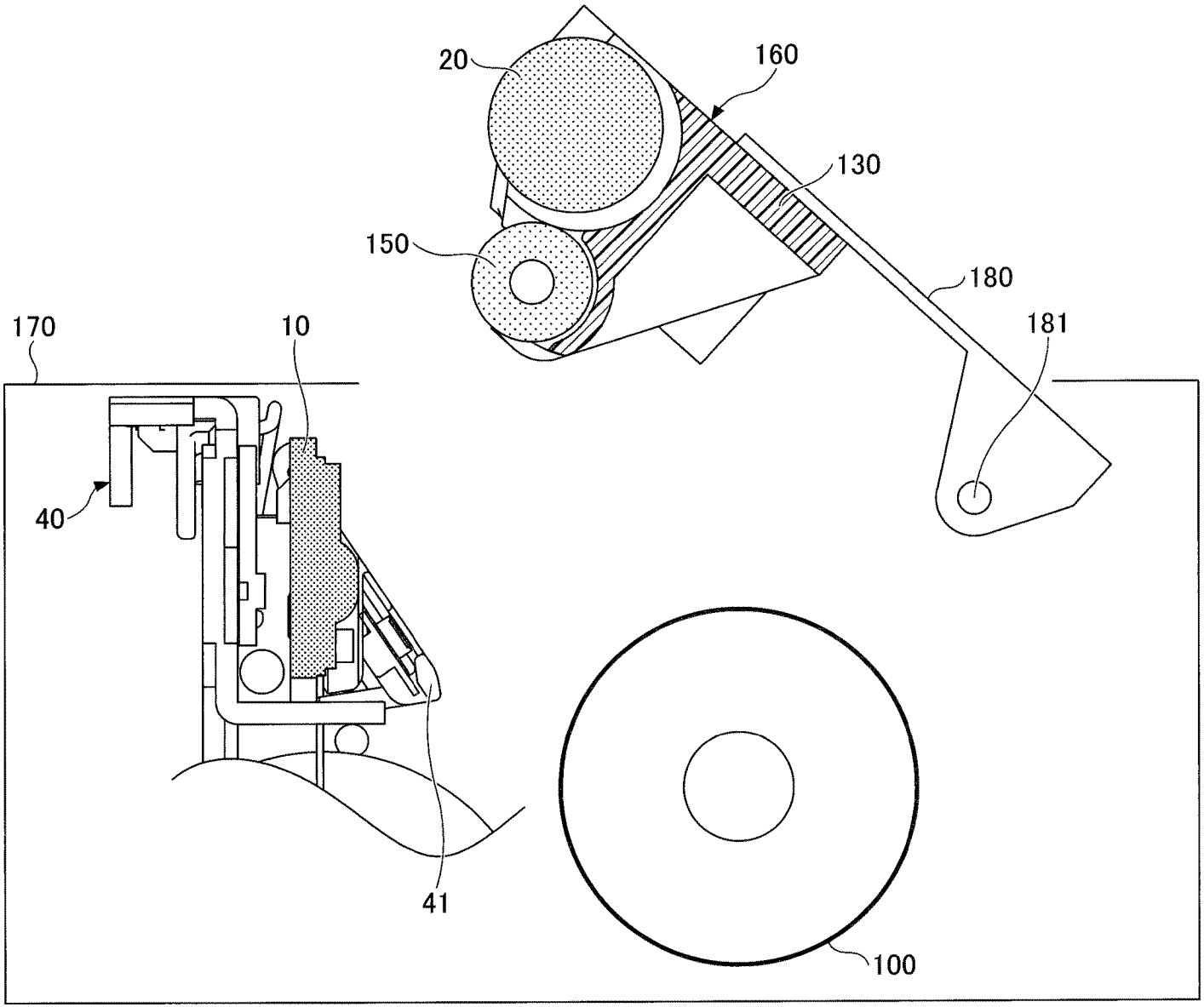
FIG. 8 is a diagram illustrating the printer with the lid open.

Referring to FIGS. 7 and 8, the printer includes a body 170 and a lid 180 attached to the body 170 in such a manner as to be pivotable about a shaft 181. FIGS. 7 and 8 are sectional views of the printer with the lid 180 closed and with the lid 180 open, respectively. The head unit 40 is attached to the body 170. The platen unit 160 is attached to the lid 180. By opening and closing the lid 180, the platen unit 160 can be detached from and attached to the head unit 40. By closing the lid 180, the print head 10 contacts the platen roller 20 to be ready for printing. A roll of the recording paper 100 can be accommodated in the body 170.

Figure 9:
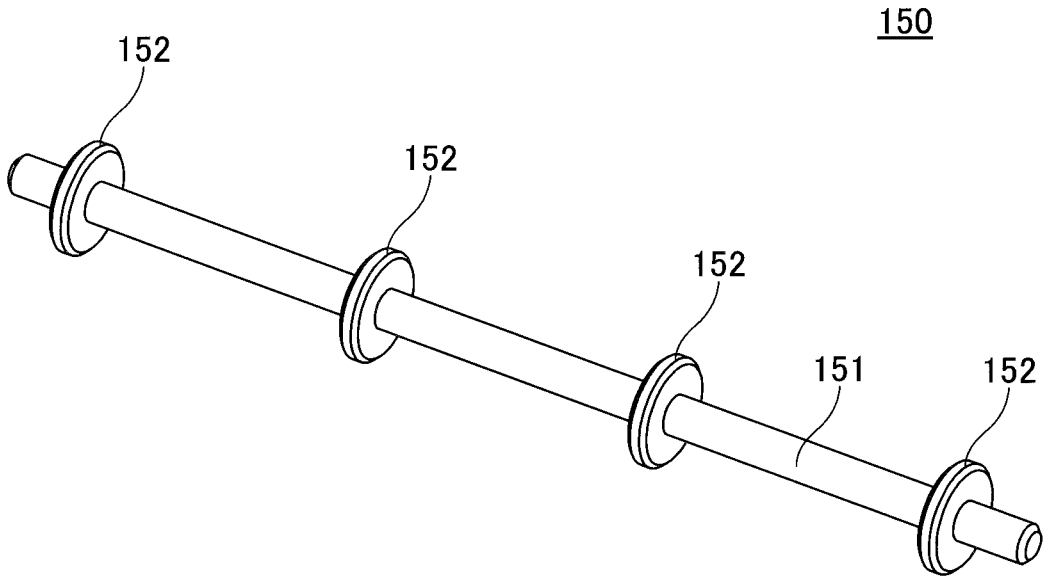
FIG. 9 is a perspective view of a guide roller according to the first embodiment.

Referring to FIG. 9, which is a perspective view of the roller 150, the roller 150 includes a rotary shaft 151 and roller parts 152 attached around the shaft 151.

The recording paper 100 is loaded into the body 170 when the lid 180 is opened as illustrated in FIG. 8. Then, the lid 180 is closed with the recording paper 100 extended up to a position where the recording paper 100 is held between the print head 10 and the platen roller 20. Thereafter, printing is performed on the recording paper 100 while conveying the recording paper 100 by rotating the platen roller 20. At this point, although the bottom surface 100*b* adheres to the circumferential edges of the roller parts 152, the adhesion of the bottom surface 100*b* does not prevent the conveyance of the recording paper 100 because the roller 150 rotates about the shaft 151 in a direction indicated by the dashed arrow A in FIG. 7 in accordance with the fed recording paper 100.

Figure 10:
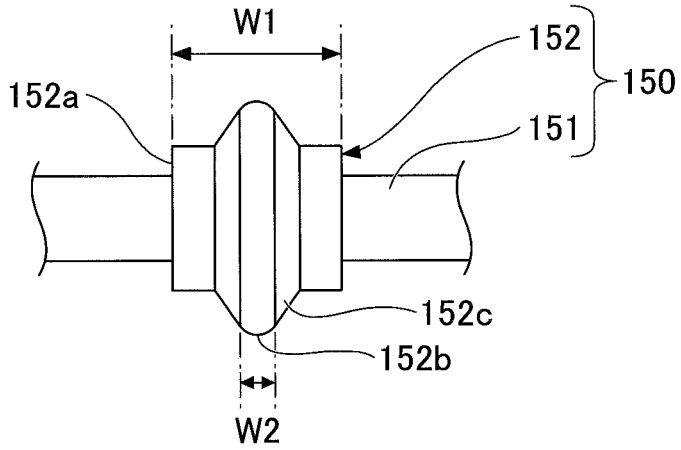
FIG. 10 is a plan view of the guide roller according to the first embodiment.

Referring to FIG. 10, which is a plan view of the roller 150, each roller part 152 includes a base 152*a* attached around the shaft 151 and a circumferential edge 152*b*. A width W2 of the edge 152*b* may be smaller than a width W1 of the base 152*a*. The roller part 152 further includes a flange 152*c* protruding radially outward from the base 152*a* having, for example, a cylindrical shape. The flange 152*c* may narrow toward its periphery and have the edge 152*b* formed on its periphery. The edge 152*b* may be rounded to define a toroidal surface. Thus, the roller part 152 has a shape tapering toward its periphery. Therefore, even when the bottom surface 100*b* adheres to the edge 152*b*, the area of adhesion between the roller part 152 and the bottom surface 100*b* is limited. Accordingly, the bottom surface 100*b* adhering to the edge 152*b* can be easily removed from the rotating roller part 152 without affecting the conveyance of the recording paper 100.

The roller parts 152 are formed of a material such as rubber, resin, or metal. The shaft 151 and the roller parts 152 may rotate together as one piece. In this case, the roller 150 may have a one-piece structure of the shaft 151 and the roller parts 152 formed of the same material. Alternatively, the shaft 151 may be fixed to the platen unit 160, and the roller parts 152 may rotate about the fixed shaft 151.

Figure 11:
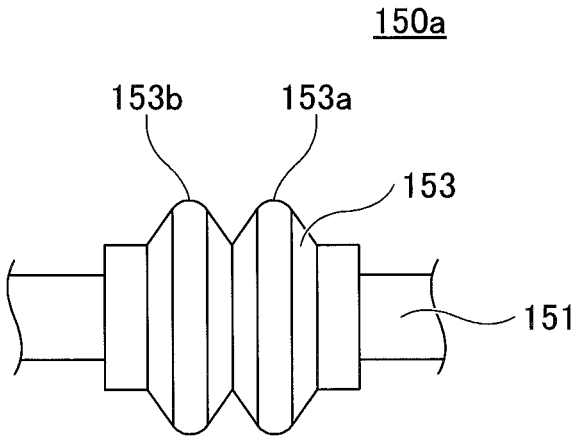
FIG. 11 is a diagram illustrating a first variation of the guide roller.

FIG. 11 illustrates a guide roller 150*a*, which is a variation of the roller 150. The roller 150*a* includes a roller part 153 that includes multiple tapered edges 153*a* and 153*b*.

Figure 12:
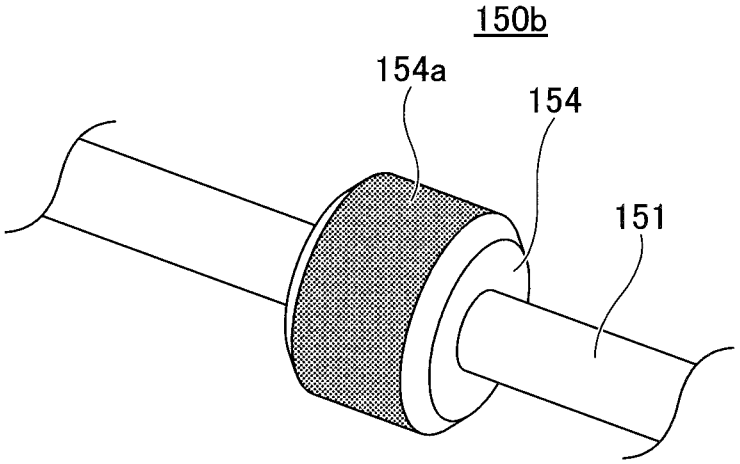
FIG. 12 is a diagram illustrating a second variation of the guide roller.

FIG. 12 illustrates a guide roller 150*b*, which is another variation of the roller 150. The roller 150*b* includes a roller part 154 whose surface 154*a* to contact the bottom surface 100*b* is provided with irregularities by grain processing.

Second Embodiment

Figure 13:
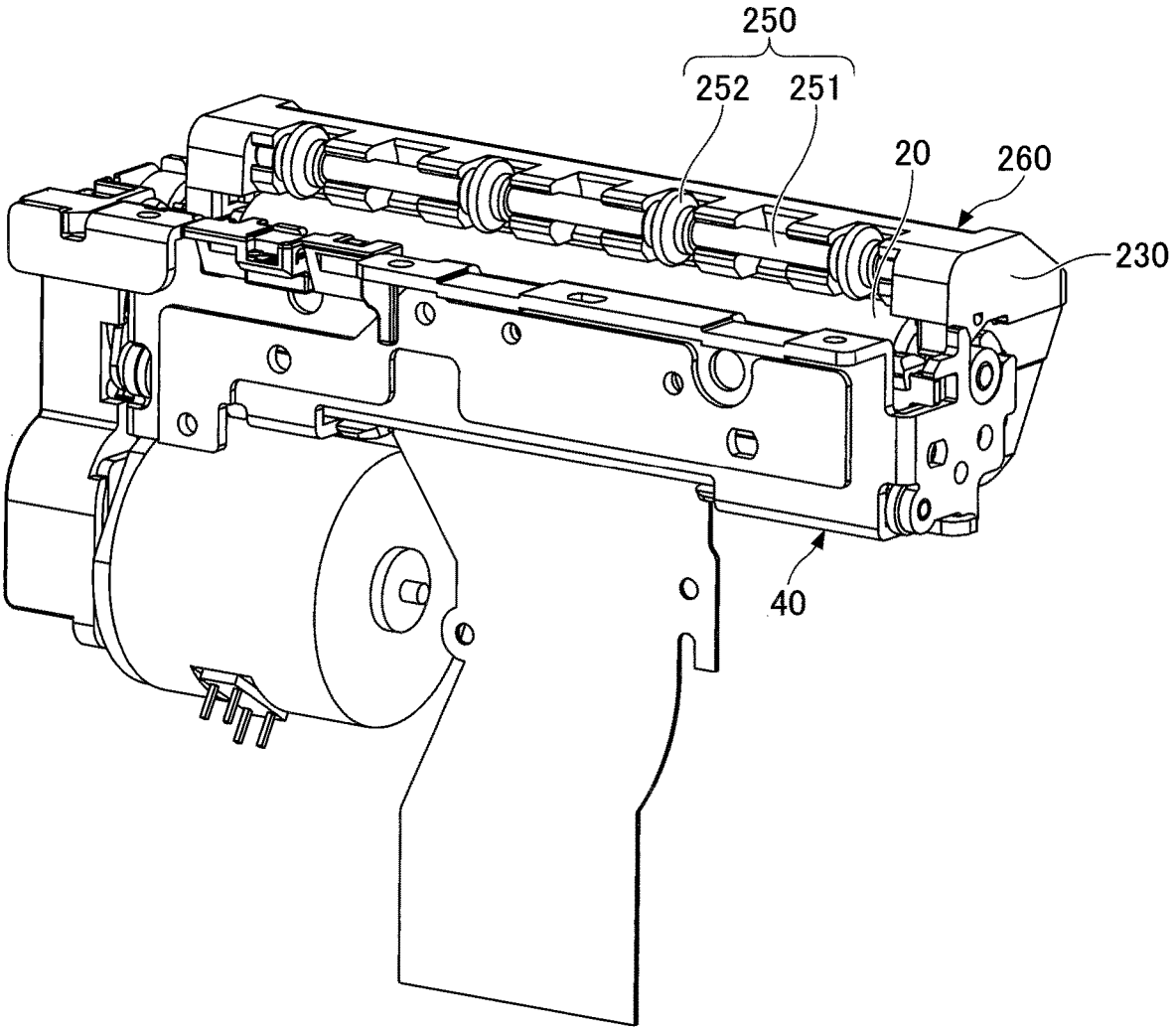
FIG. 13 is a perspective view of a printer according to a second embodiment.
Figure 14:
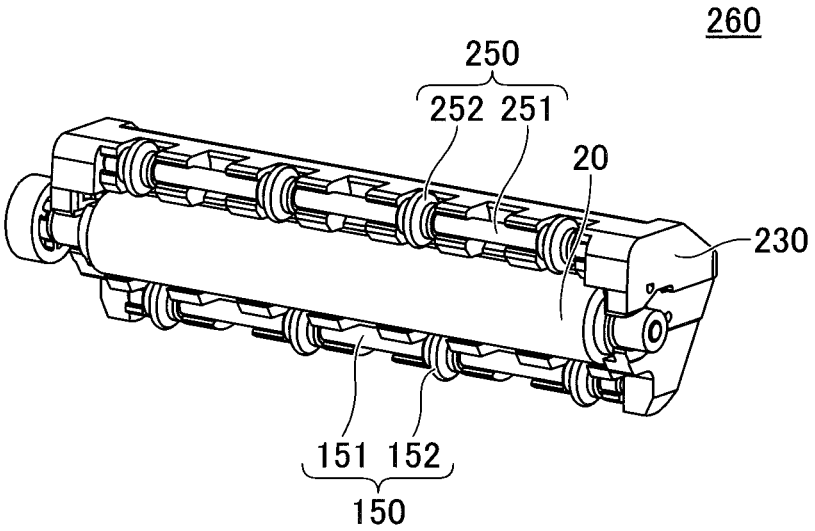
FIG. 14 is a perspective view of a platen unit according to the second embodiment.
Figure 15:
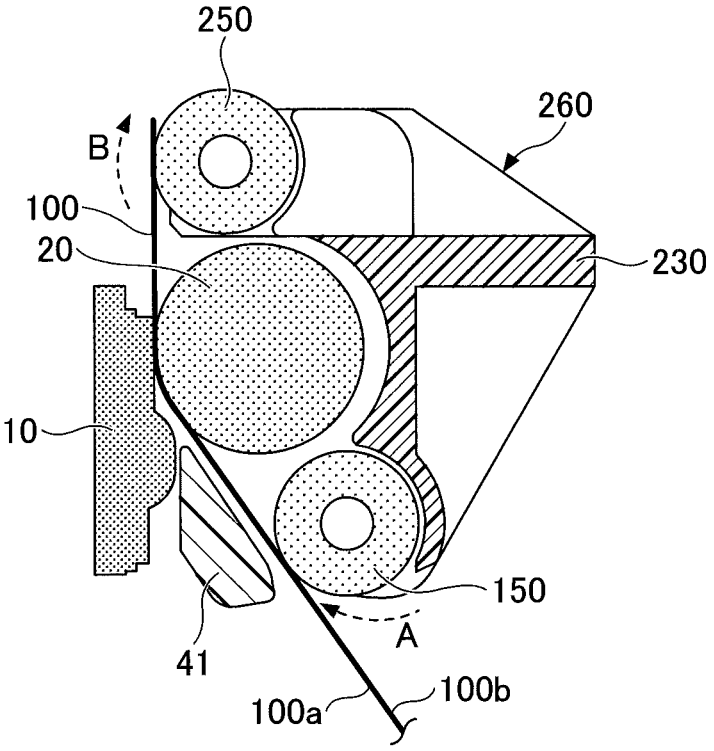
FIG. 15 is a partial cross-sectional view of the printer according to the second embodiment.

A printer according to a second embodiment is described with reference to FIGS. 13 through 15. FIG. 13 is a partial perspective view of the printer. FIG. 14 is a perspective view of a platen unit of the printer. FIG. 15 is a partial cross-sectional view of the printer.

The printer includes the head unit 40 and a platen unit 260. The platen unit 260 includes the platen roller 20, a support 230, the roller 150, and a guide roller 250. The rollers 150 and 250 are provided upstream and downstream, respectively, of the print head 10 and the platen roller 20 in the conveyance direction.

The roller 250 has the same structure as the roller 150. Referring to FIG. 14, the roller 250 includes a rotary shaft 251 and roller parts 252 attached around the shaft 251.

Referring to FIG. 15, as the platen roller 20 rotates clockwise to convey the recording paper 100, the roller 150 contacting the recording paper 100 rotates clockwise as indicated by the dashed arrow A, and the roller 250 contacting the recording paper 100 rotates clockwise as indicated by the dashed arrow B while the recording paper 100 is fed.

By providing the roller 250, it is possible to further prevent the possibility that the recording paper 100 wraps around the platen roller 20 or gets jammed between the platen roller 20 and the support 230 because of static electricity or the curling of the recording paper 100 after printing by the print head 10.

In other respects than those described above, the second embodiment may be the same as the first embodiment.

Third Embodiment

Figure 16:
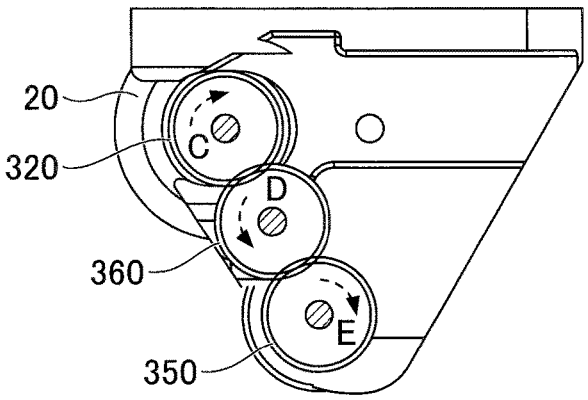
FIGS. 16 and 17 are diagrams illustrating a printer according to a third embodiment.
Figure 17:
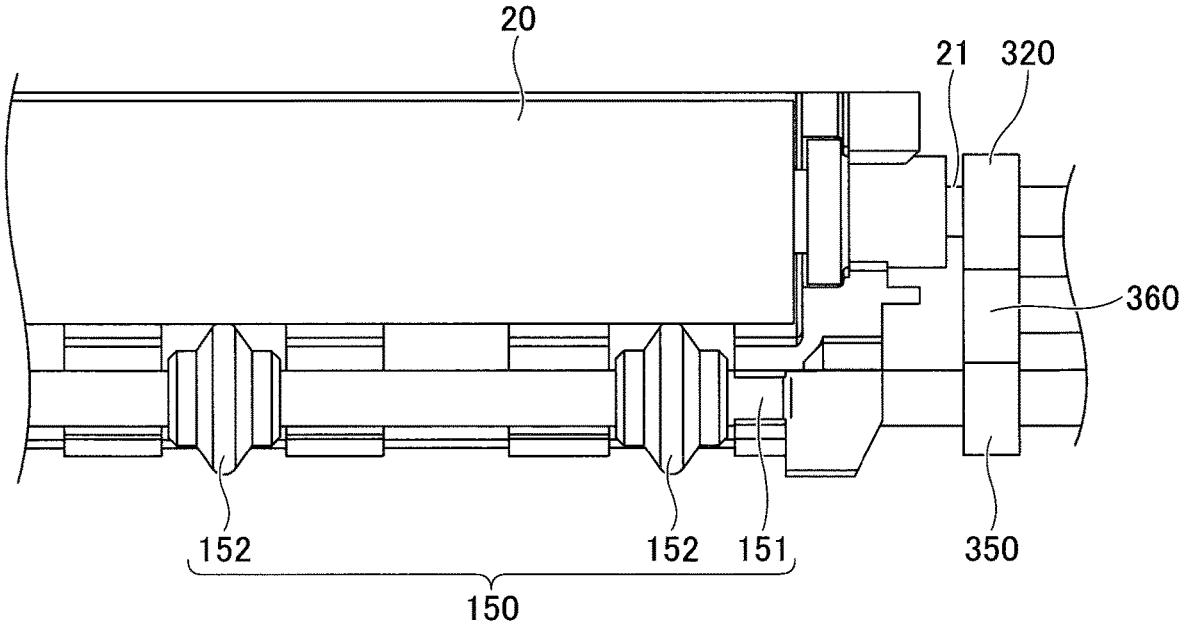

A printer according to a third embodiment is described with reference to FIGS. 16 and 17. FIG. 16 is a partial side view of the printer. FIG. 17 is a partial plan view of the printer. The printer includes a transmission gear 360 that transmits the rotation of the platen roller 20 to the roller 150.

The printer further includes a platen gear 320 that rotates with the platen roller 20 and a roller gear 350 that rotates with the roller 150. The gear 320 is provided at an end of a rotary shaft 21 of the platen roller 20. The gear 350 is provided at an end of the shaft 151. The gears 320 and 350 mesh with the gear 360.

Referring to FIG. 16, as the platen roller 20 rotates clockwise as indicated by the dashed arrow C to convey the recording paper 100, the gear 320 rotates clockwise to rotate the gear 360 counterclockwise in a direction of the dashed arrow D, so that the gear 350 rotates clockwise in a direction of the dashed arrow E. As the gear 350 rotates clockwise, the roller parts 152 rotate clockwise. As a result, the roller 150 can operate as a conveyance roller that assists the conveyance of the recording paper 100.

In other respects than those described above, the third embodiment may be the same as the first embodiment.

Although one or more embodiments of the present invention have been described heretofore, the present invention is not limited to these embodiments, and variations and modifications may be made without departing from the scope of the present invention.

What is claimed is:

1. A printer comprising:

a head unit including a print head; and a platen unit, the platen unit including a platen roller configured to rotate to convey a recording sheet;

a guide roller including a roller part, the roller part being configured to rotate in contact with the recording sheet as the recording sheet is conveyed through a path; and a support to which the platen roller and the guide roller are directly attached rotatably, the support being on an opposite side of the path from the print head.

2. The printer as claimed in claim 1, further comprising:

a platen gear provided on a shaft of the platen roller;

a roller gear provided on a shaft of the guide roller; and a transmission gear meshing with the platen gear and the roller gear, wherein a rotation of the platen roller is transmitted to the guide roller via the platen gear, the transmission gear, and the roller gear in order.

3. The printer as claimed in claim 1, wherein a dimension of the roller part in an axial direction of the guide roller is smaller at an edge of the roller part than at a base of the roller part, the base being closer to a shaft of the roller part than the edge.

4. The printer as claimed in claim 1, wherein the guide roller includes a first roller and a second roller that are provided upstream and downstream, respectively, of the platen roller in a direction in which the recording sheet is conveyed.

5. The printer as claimed in claim 1, wherein the guide roller is attached to the support upstream of the print head and the platen roller in a direction in which the recording sheet is conveyed.

6. The printer as claimed in claim 1, wherein the roller part includes a base attached around a shaft of the guide roller and a flange protruding radially outward from the base, and a dimension of the flange in an axial direction of the guide roller decreases toward a periphery of the flange.

7. The printer as claimed in claim 1, further comprising:

a guide configured to guide the recording sheet conveyed through the path, the guide being provided on the head unit upstream of the print head in a direction in which the recording sheet is conveyed, the guide facing the guide roller across the path.

* * * * *